US006378509B1

(12) United States Patent
Feucht et al.

(10) Patent No.: US 6,378,509 B1
(45) Date of Patent: Apr. 30, 2002

(54) EXHAUST GAS RECIRCULATION SYSTEM HAVING MULTIFUNCTION VALVE

(75) Inventors: Dennis D. Feucht, Morton; David A. Pierpont, Peoria, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/592,799

(22) Filed: Jun. 13, 2000

(51) Int. Cl.[7] ..... F02M 25/07

(52) U.S. Cl. ..... 123/568.12; 60/605.2; 137/625.15

(58) Field of Search ..... 123/568.12, 568.24; 60/605.2; 137/625, 625.2, 625.11–625.16

(56) References Cited

U.S. PATENT DOCUMENTS

| | | | | |
|---|---|---|---|---|
| 2,736,339 A | | 2/1956 | Asbury et al. | |
| 3,083,693 A | | 4/1963 | Kunz | |
| 3,776,207 A | * | 12/1973 | Simko | 123/567.12 |
| 3,986,397 A | | 10/1976 | Perreault | |
| 4,055,151 A | | 10/1977 | Cummings et al. | |
| 4,179,892 A | * | 12/1979 | Heydrich | 60/605 |
| 4,286,624 A | | 9/1981 | Clausen et al. | |
| 4,554,942 A | | 11/1985 | Williams et al. | |
| 4,574,842 A | | 3/1986 | Cordova | |
| 4,621,679 A | | 11/1986 | Byers et al. | |
| 4,705,627 A | | 11/1987 | Miwa et al. | |
| 5,251,670 A | | 10/1993 | Bates | |
| 5,375,622 A | | 12/1994 | Houston | |
| 5,692,892 A | * | 12/1997 | Houston | 432/181 |

* cited by examiner

*Primary Examiner*—Henry C. Yuen
*Assistant Examiner*—Arnold Castro
(74) *Attorney, Agent, or Firm*—Taylor & Aust, P.C.

(57) ABSTRACT

A multifunction valve, particularly suited for use in an internal combustion engine, provides adjustable EGR thereto. The internal combustion engine has a block defining a plurality of combustion cylinders, each combustion cylinder of the plurality of combustion cylinders having a displacement volume. An intake manifold is fluidly connected to the block to supply combustion air to each combustion cylinder. The intake manifold has an air intake port and a first EGR inlet port. A secondary exhaust manifold is fluidly coupled to at least one of the plurality of combustion cylinders. The secondary exhaust manifold has an exhaust outlet port. A multipurpose valve has a first valve inlet port, a waste gas outlet port and a first EGR outlet port, wherein the first valve inlet port is fluidly connected to the exhaust outlet port of the secondary exhaust manifold, the waste gas outlet port is in communication with the atmosphere, and the first EGR outlet port is fluidly coupled to the first EGR inlet port of the intake manifold.

25 Claims, 4 Drawing Sheets

EXHAUST GAS RECIRCULATION SYSTEM HAVING MULTIFUNCTION VALVE

TECHNICAL FIELD

The present invention relates to an exhaust gas recirculation system for an internal combustion engine, and, more particularly, to an exhaust gas recirculation system having a multifunction valve.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment.

EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NOx). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

Some internal combustion engines include turbochargers to increase engine performance, and are available in a variety of configurations. When utilizing EGR in a turbocharged diesel engine, the exhaust gas to be recirculated is preferably removed upstream of the exhaust gas driven turbine associated with the turbocharger. In many EGR applications, the exhaust gas is diverted by a poppet-type EGR valve directly from the exhaust manifold. The percentage of the total exhaust flow which is diverted for introduction into the intake manifold of an internal combustion engine is known as the EGR rate of the engine.

The reintroduction of exhaust gases will occur naturally when the exhaust manifold pressure is higher than the turbocharger boost pressure. In a low pressure system, the pressure difference simply pushes At the exhaust gas into the air intake before the turbocharger compressor. The disadvantage of this approach is the potential fouling of the turbocharger compressor and the air-to-air intercooler of the engine, if so equipped.

High pressure systems typically pump exhaust gas directly into the intake manifold of the engine. However, when such a turbocharged engine operates under lower speed and high torque conditions, the boost pressure is higher than the exhaust manifold pressure and recirculation of exhaust gasses is not possible. Earlier approaches to address this problem have included using devices such as back pressure valves, restrictive turbines, throttle valves and venturi inlet systems. Each can be used to improve the back pressure to boost pressure gradient to some degree, but each approach results in increased fuel consumption.

In controlling EGR, simple valves are sometimes used to direct the flow of exhaust gases for EGR, but such valves are not readily adaptable to accommodate sophisticated EGR system designs. Also, while multi-port valves, such as the valve disclosed in U.S. Pat. No. 3,083,693, have been used in relatively stable environments, commercially available versions of such valves are generally inadequate to handle the harsh environment or the control complexity of sophisticated EGR systems.

The present invention is directed to overcoming one or more of the problems as set forth above.

DISCLOSURE OF THE INVENTION

In one aspect of the invention, an internal combustion engine provides an intake manifold fluidly connected to a block to supply combustion air to each combustion cylinder. The intake manifold has an air intake port and a first EGR inlet port. A secondary exhaust manifold is fluidly coupled to at least one of the plurality of combustion cylinders. The secondary exhaust manifold has an exhaust outlet port. A multipurpose valve has a first valve inlet port, a waste gas outlet port and a first EGR outlet port, wherein the first valve inlet port is fluidly connected to the exhaust outlet port of the secondary exhaust manifold, the waste gas outlet port is in communication with the atmosphere, and the first EGR outlet port is fluidly coupled to the first EGR inlet port of the intake manifold.

In another aspect of the invention, a multifunction valve for adjusting EGR in an internal combustion engine provides a valve body having a plurality of cavities; a valve cap defining an exhaust gas pocket; and a rotor having a first surface, a second surface, a selection port and an air pocket defined by the first surface.

In another aspect of the invention, a method of operating a multifunction valve in an EGR system for an internal combustion engine which generates exhaust gases provides the steps of: operating the multifunction valve in a first position to supply exhaust gas from a second exhaust manifold to a first exhaust manifold; and operating the multifunction valve in a second position to supply a portion of the exhaust gas from the second exhaust manifold to the first exhaust manifold and to at least partially open a waste port to waste a portion of the exhaust gases.

BEST MODE FOR CARRYING OUT THE INVENTION

Figure 1:
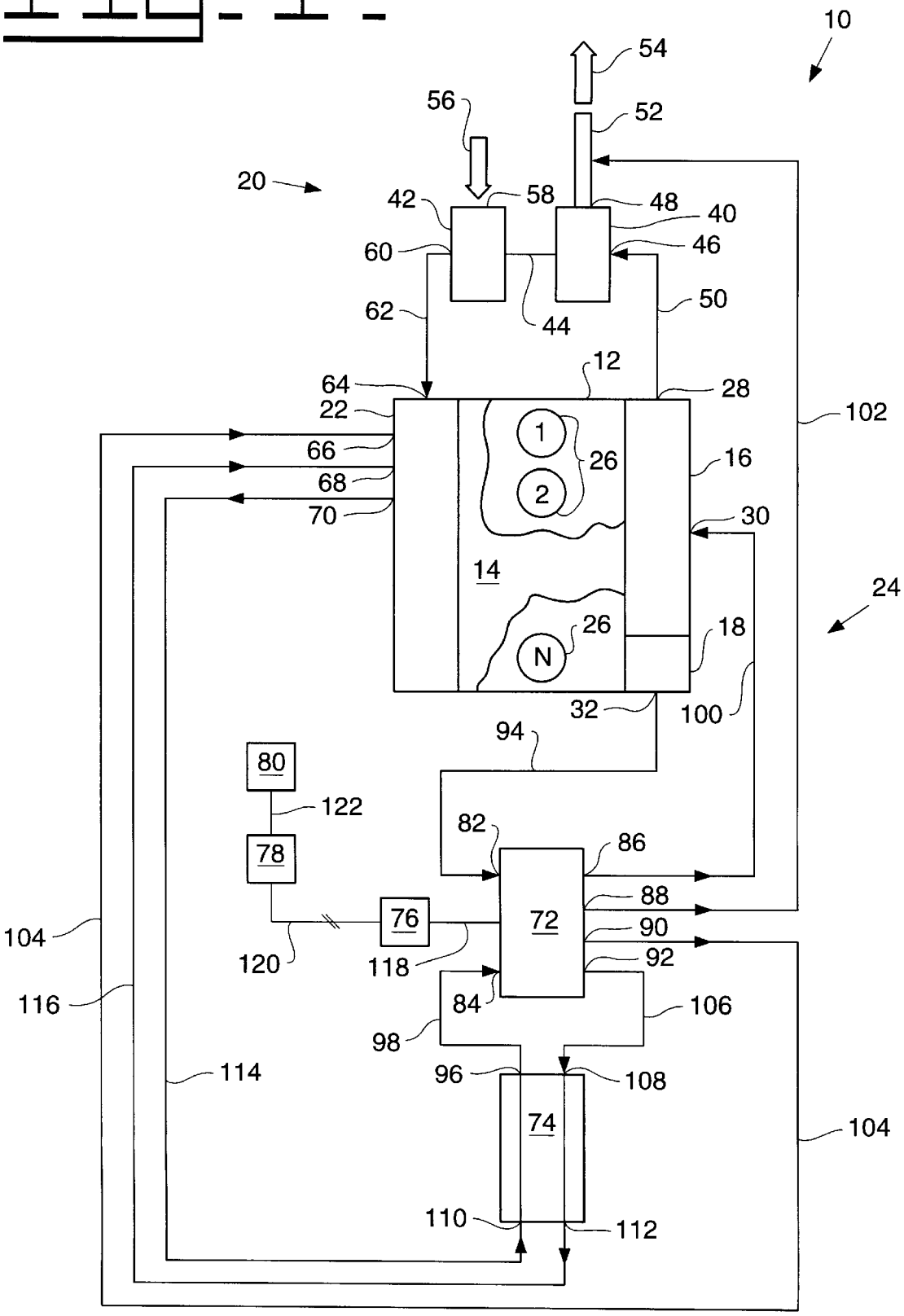
FIG. 1 is a schematic illustration of an internal combustion engine including the EGR system of the present invention.

Referring FIG. 1, there is shown a schematic representation of an embodiment of an internal combustion engine 10 of the present invention. Internal combustion engine 10 generally includes a block 12, a cylinder head 14, a first exhaust manifold 16, a second exhaust manifold 18, a turbocharger 20, an intake manifold 22 and an EGR system 24.

Block 12 defines a plurality of combustion cylinders 26 individually identified as cylinders 1 to N. The number N of combustion cylinders 26 may be selected dependent upon a specific application. For example, block 12 may include six, ten or twelve combustion cylinders 26, in which case N=6,10,or 12, respectively. Each combustion cylinder 26 has a displacement volume which is the volumetric change within each combustion cylinder 26 as an associated piston (not shown) moves from a bottom dead center to a top dead center position, or vice versa. The displacement volume may be selected dependent upon the specific application of internal combustion engine 10. The sum of the displacement volumes for each of combustion cylinders 26 defines a total displacement volume for internal combustion engine 10.

Cylinder head 14 is connected to block 12 in a manner known to those skilled in the art, and is shown with a section broken away to expose block 12. As each of the pistons moves to its respective top dead center position, each piston and the cylinder head 14 define a combustion chamber therebetween. In the embodiment shown, cylinder head 14 is a single cylinder head and includes a plurality of exhaust valves (not shown) and a plurality of intake valves (not shown). Exhaust manifolds 16, 18 and intake manifold 22 are connected to cylinder head 14, and are fluidly coupled to the plurality of combustion cylinders 26.

Exhaust manifold 16 includes cylinder ports fluidly connected to receive combustion products from cylinders 1-to-(N−1) of combustion cylinders 26, and exhaust manifold 18 is fluidly connected to receive combustion products from cylinder N of combustion cylinders 26. Exhaust manifold 16 includes an exhaust outlet port 28 and a fluid inlet port 30. Exhaust manifold 18 includes an exhaust outlet port 32.

Turbocharger 20 includes a turbine 40 and a compressor 42. Turbine 40 is driven by the exhaust gases which flow from exhaust outlet port 28 of exhaust manifold 16. Turbine 40 is coupled with compressor 42 via a shaft 44 and rotatably drives compressor 42. Turbine 40 includes an exhaust gas inlet 46 and an exhaust gas outlet 48. Exhaust gas inlet 46 is connected to exhaust outlet port 28 of exhaust manifold 16 via fluid conduit 50. Exhaust gas outlet 48 of turbine 40 is connected to an exhaust pipe 52, which in turn is in fluid communication with the atmosphere for expelling exhaust gases.

Compressor 42 receives combustion air (as indicated by arrow 56) through compressor inlet 58 from the ambient environment and provides compressed combustion air through compressor outlet 60 via fluid conduit 62 to an air intake port 64 of intake manifold 22. Alternatively, an air cooler (not shown) may be inserted between compressor 42 and intake port 64 to cool the combustion air prior to delivery to intake manifold 22.

Intake manifold 22 further includes a hot EGR inlet port 66, a cold EGR inlet port 68 and an air outlet port 70.

EGR system 24 includes a multifunction valve 72, a heat exchanger 74, an actuator 76, an EGR controller 78, and a sensor assembly 80.

Multifunction valve 24 includes valve inlet ports 82 and 84 and valve outlet ports 86, 88, 90, and 92. Valve inlet port 82 is connected to exhaust outlet port 32 of exhaust manifold 18 via a fluid conduit 94. Valve inlet port 84 is connected to air outlet 96 of heat exchanger 74 via conduit 98. Valve outlet port 86 is connected to fluid inlet port 30 of exhaust manifold 16 via fluid conduit 100. Valve outlet port 88 is connected to exhaust pipe 52 via fluid conduit 102. Valve outlet port 90 is connected to hot EGR inlet port 66 of intake manifold 22 via fluid conduit 104. Valve outlet port 92 is connected via fluid conduit 106 to EGR inlet 108 of heat exchanger 74.

Heat exchanger 74 also includes an air inlet 110 which is connected within heat exchanger 74 to air outlet 96. Heat exchanger 74 further includes an EGR outlet 112 which is connected within heat exchanger 74 to EGR inlet 108. Air inlet 110 of heat exchanger 74 is connected via fluid conduit 114 to air outlet port 70 of intake manifold 22. EGR outlet 112 of heat exchanger 74 is connected via fluid conduit 116 to cold EGR inlet port 68 of intake manifold 22. Thus, in general, heat exchanger 74 is a dual path heat exchanger including at least one fluid passageway through which non-compressed exhaust gas flows, and at least one fluid passageway through which intake manifold air flows. Optionally, cooling air, or engine coolant, flows around the fluid passageways to cool the exhaust gas and air transported through the passageways.

For sake of clarity, each conduit shown in FIG. 1 includes an arrow head which depicts the general fluid flow direction associated therewith.

Multifunction valve 72 includes a plurality of operating positions which are selectable via actuator 76 based upon control commands supplied by EGR controller 78 in view of sensor signals received from sensor assembly 80. Preferably, multifunction valve 72 is a rotary valve having a rotatable shaft 118 which is mechanically coupled to actuator 76. Actuator 76 is electrically connected to EGR controller 78 via electrical cable 120. EGR controller 78 is electrically connected to sensor assembly 80 via electrical cable 122.

Preferably, EGR controller 78 includes a microprocessor having an associated.memory, and has preprogrammed instructions stored in the memory. Also preferably, the preprogrammed instructions can be modified by connecting EGR controller 78 to an input device (not shown), such as a key pad or key board. EGR controller 78 receives sensor input signals from sensor assembly 80 via electrical cable 122, and executes the preprogrammed instructions to effect the generation of appropriate control signals for use in controlling a rotational displacement of actuator 76, which in turn controls a rotational displacement of shaft 118 of multifunction valve 72.

Figure 2:
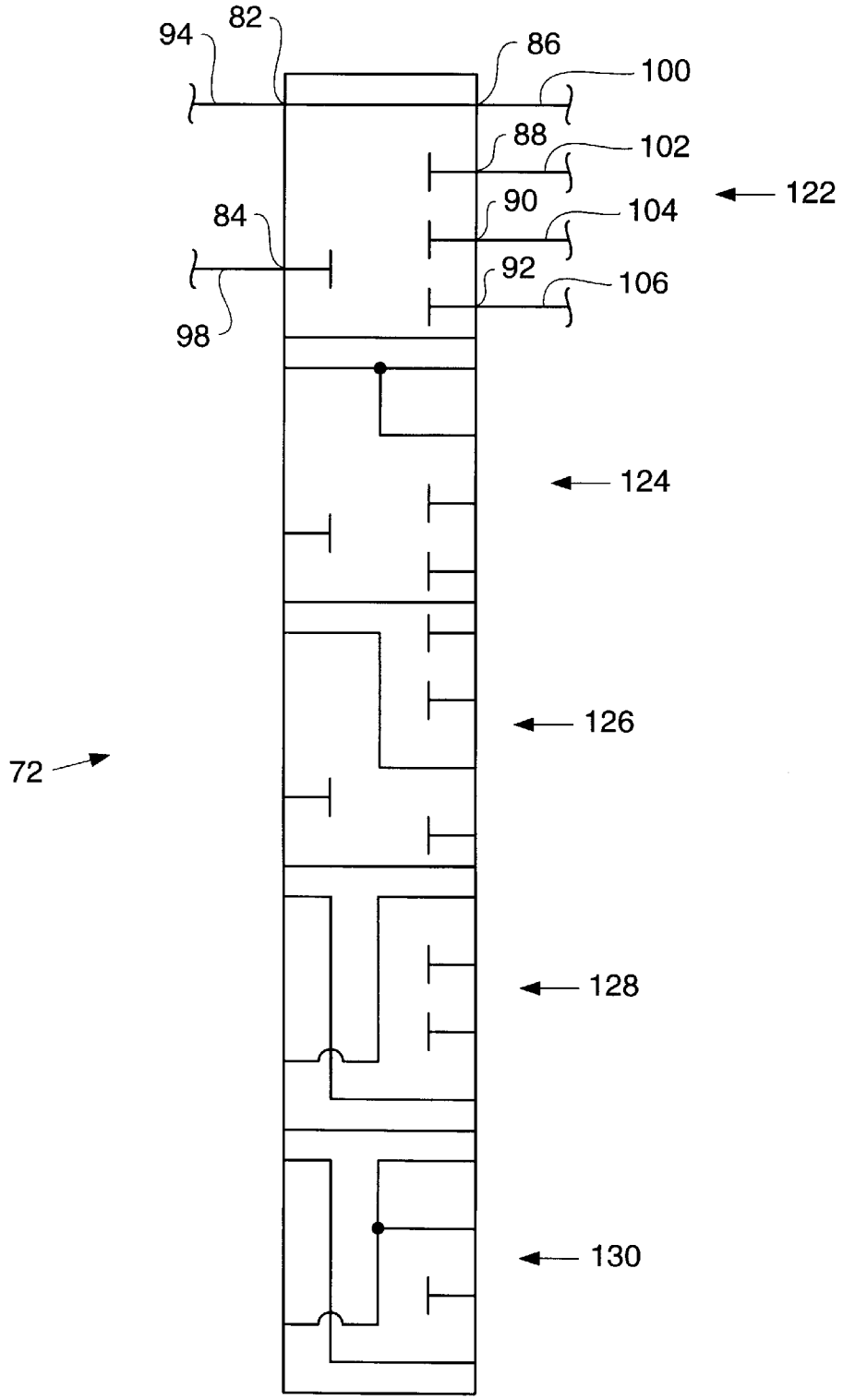
FIG. 2 is a schematic illustration of a multifunction valve of the present invention.

FIG. 2 schematically illustrates a preferred embodiment of multifunction valve 72. As shown, multifunction valve 72 includes five operating positions which result in corresponding valve internal configurations 123, 124, 126, 128 and 130. When multifunction valve 72 is operated to a first position, corresponding to a first internal configuration 123, inlet port 82 is connected to outlet port 86, and no other internal connections are made. When multifunction valve 72 is operated to a second position, corresponding to a second internal configuration 124, inlet port 82 is connected to outlet ports 86 and 88, and no other internal connections are made. When multifunction valve 72 is operated to a third position, corresponding to a third internal configuration 126, inlet port 82 is connected to outlet port 90, and no other internal connections are made. When multifunction valve 72 is operated to a fourth position, corresponding to a fourth internal configuration 128, inlet port 82 is connected to outlet port 92, inlet port 84 is connected to outlet port 86, and no other internal connections are made. When multifunction valve 72 is operated to a fifth position, corresponding to a fifth internal configuration 130, inlet port 82 is connected to outlet 92, inlet port 84 is connected to outlet ports 86,88, and no other internal connections are made.

Figure 3:
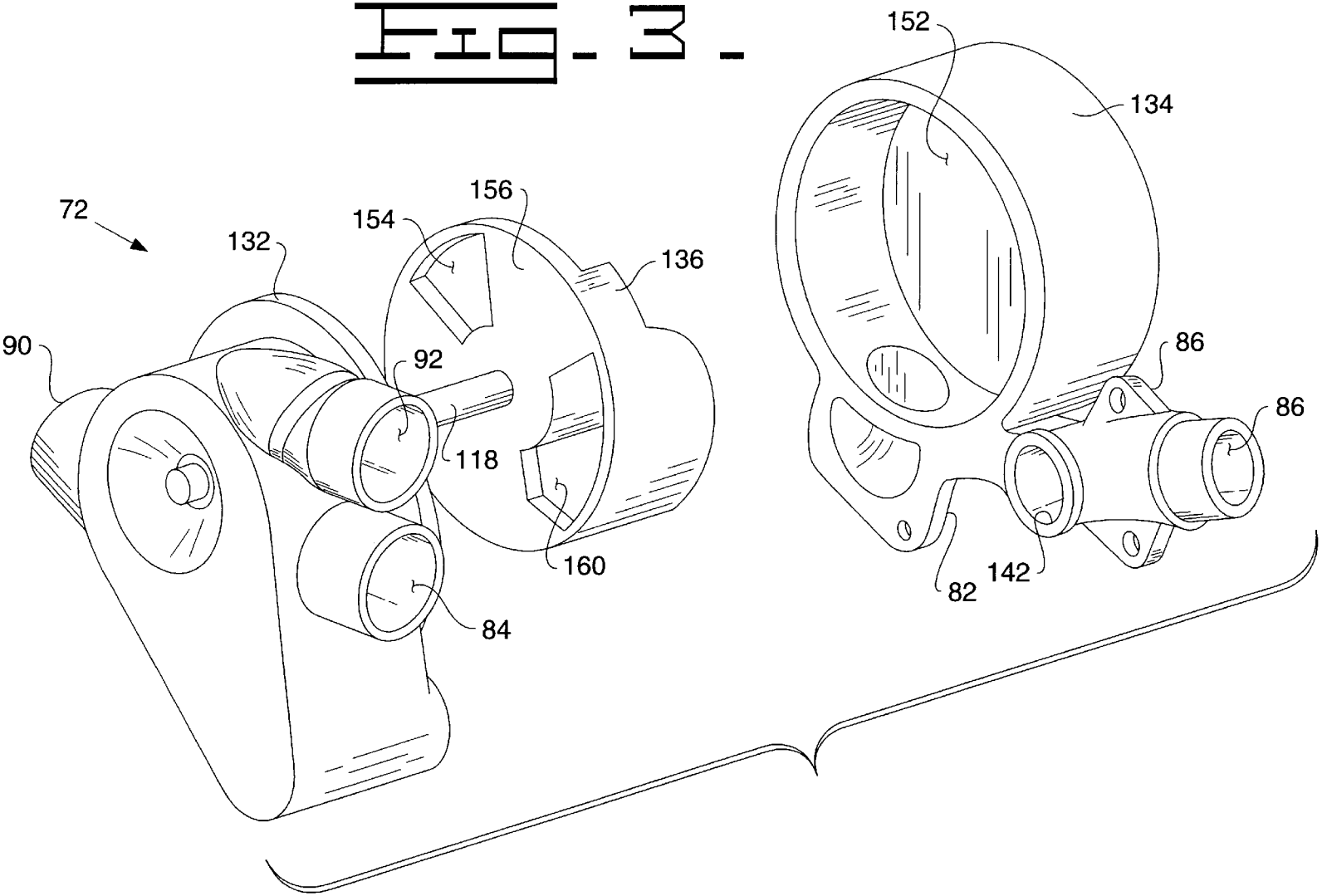
FIG. 3 is a front exploded view of the multifunction valve schematically illustrated in FIG. 2.
Figure 4:
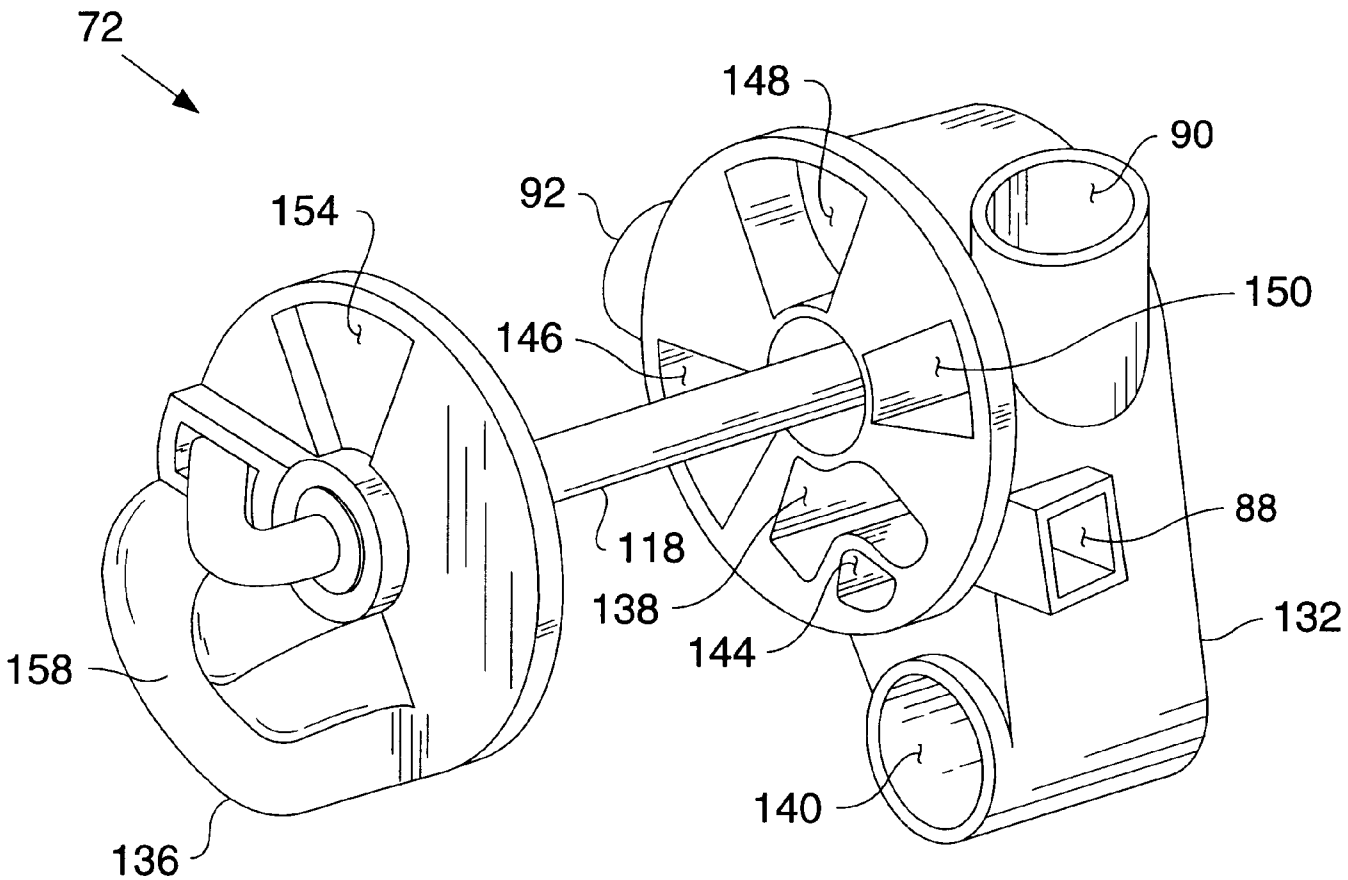
FIG. 4 is a rear exploded view of a portion of the multifunction valve depicted in FIG. 3.

FIGS. 3 and 4 show front and rear, respectively, perspective exploded views of multifunction valve 72, as schematically illustrated in FIG. 2. Multifunction valve 72 includes a valve body 132, a valve cap 134 and a valve rotor 136.

Referring to FIG. 4 in relation to FIG. 3, valve body 132 includes an exhaust gas cavity 138 in fluid communication with outlet port 86 via intermediate connection ports 140, 142; a waste exhaust gas cavity 144 in fluid communication with outlet 88; a hot air cavity 146 in fluid communication with inlet port 84; an exhaust gas cavity 148 in fluid communication with outlet 92; and an exhaust gas cavity 150 in fluid communication with outlet port 90.

Referring to FIG. 3, valve cap 134 defines an exhaust gas pocket 152 which is in fluid communication with inlet port 82. Valve rotor 136 generally separates valve body 132 from valve cap 134, except for permitting a fluid flow from valve cap 134 to valve body 132 via selection port 154 in valve rotor 136. Valve rotor 136 includes a first surface 156 positioned to face valve body 132 and includes a second surface 158 which is positioned to face exhaust gas pocket 152 of valve cap 134. Valve rotor 136 further includes an air pocket, or cavity, 160 which is defined by surface 156. Selection port 154 and air pocket 160 combine to effect the various internal configurations 123, 124, 126, 128, 130 of valve 72, as depicted in FIG. 2, which are associated with a selected rotary position of valve rotor 136.

Industrial Applicability

During use, EGR controller 78 receives sensor input signals from sensor assembly 80 via electrical cable 122, and executes the preprogrammed instructions to effect the generation of appropriate control signals for use in controlling a rotational displacement of actuator 76, which in turn controls a rotational displacement of shaft 118 of multifunction valve 72. Sensor assembly 76 is adapted, for example, to monitor the status of one or more of: $CO_2$ content of exhaust gas, $NO_x$ content of exhaust gas, $O_2$ content of exhaust gas, EGR air flow rate, engine speed, and altitude. Multifunction valve 72 is operable among a plurality of operating positions corresponding to those shown in FIG. 2.

When operating multifunction valve 72 in position 1, corresponding to internal valve configuration 123, exhaust gases are supplied from second exhaust manifold 18 to first exhaust manifold 16. Position 1 is selected by EGR controller when no EGR is desired, and it is desired to supply a full flow of all available exhaust gases from exhaust manifolds 16, 18 to turbine 40 of turbocharger 20.

When operating multifunction valve 72 in position 2, corresponding to internal configuration 124, at least a portion of the exhaust gas from second exhaust manifold 18 is diverted to first exhaust manifold 16, and a waste port 88 is at least partially opened to waste a portion of the exhaust gases of the internal combustion engine 10 to the atmosphere via exhaust pipe 52. Position 2 is selected by EGR controller when no EGR is desired, and it is desired to supply a part of the full flow of exhaust gases from exhaust manifolds 16, 18 to turbine 40 of turbocharger 20, while wasting a portion of the full flow of exhaust gases to limit the revolution velocity of turbocharger turbine 40 to prevent turbocharger over speed and/or control the level of the boost pressure in the inlet manifold 22.

When operating multifunction valve 72 in position 3, corresponding to internal configuration 126, non-cooled (i.e., hot) exhaust gas from second exhaust manifold 18 is delivered directly to intake manifold 22 via fluid conduit 104. Position 3 is selected to lower particulate content in the exhaust gases generated at low load conditions, and to lessen oil or fuel fouling of heat exchanger 74 in the cooler operating ranges of internal combustion engine 10 by bypassing heat exchanger 74 altogether.

When operating multifunction valve 72 in position 4, corresponding to internal configuration 128, exhaust gas from exhaust manifold 18 is supplied to heat exchanger 74, which in turn provides cooled exhaust gas to intake manifold 22 via fluid conduit 116. Also, air received from intake manifold 22 via fluid conduit 114, heat exchanger 74 and fluid conduit 98 is supplied to first exhaust manifold 16 via fluid conduit 100. Position 4 is selected to maintain mass flow to turbocharger 20 during high load conditions detected by EGR controller 78, while providing cooled EGR to prevent overheating of internal combustion engine 10 and to obtain optimum engine efficiency.

When operating multifunction valve 72 in position 5, corresponding to internal configuration 130, cooled EGR is provided by supplying exhaust gas from exhaust manifold 18 to heat exchanger 74, which in turn supplies cooled exhaust gases to intake manifold 22. Air received from intake manifold 22 is supplied to first exhaust manifold 16, and waste port 90 is at least partially opened to waste a portion of the exhaust gases received from exhaust manifold 18 and/or exhaust manifold 16. Position 5 is selected to maintain mass flow to turbocharger 20 during high load conditions detected by EGR controller 78, while providing cooled EGR to prevent overheating of internal combustion engine 10 and to obtain optimum engine efficiency, and also while wasting a portion of the full flow of exhaust gases to limit the revolution velocity of turbocharger turbine 40 to prevent turbocharger over speed or to control the boost level in the intake manifold.

By utilizing a multifunction valve 72, EGR system 24 of the invention advantageously removes the waste gate from the turbocharger to provide a system cost savings and an improved apparatus for controllably wasting gas so as to prevent turbocharger over speed, both during EGR and in the absence of EGR. In addition, the invention advantageously provides both hot and cooled EGR to internal combustion engine 10 to permit the use of the EGR system over a broader operating range of engine, as compared to prior EGR systems.

Other aspects, objects and advantages of this invention can be obtained from a study of the drawings, the disclosure and the appended claims.

What is claimed is:

1. An internal combustion engine, comprising:

a block defining a plurality of combustion cylinders, each combustion cylinder of said plurality of combustion cylinders having a displacement volume;

an intake manifold fluidly connected to said block to supply combustion air to said each combustion cylinder, said intake manifold having an air intake port and a first EGR inlet port;

a secondary exhaust manifold fluidly coupled to at least one of said plurality of combustion cylinders, said secondary exhaust manifold having an exhaust outlet port; and a multipurpose valve having a first valve inlet port, a waste gas outlet port and a first EGR outlet port, said first valve inlet port being fluidly connected to said exhaust outlet port of said secondary exhaust manifold, said waste gas outlet port being in communication with the atmosphere, and said first EGR outlet port being fluidly coupled to said first EGR inlet port of said intake manifold.

2. The internal combustion engine of claim 1, including:

a heat exchanger having an EGR gas inlet and an EGR gas outlet;

said intake manifold having a second EGR inlet port fluidly connected with said EGR gas outlet of said heat exchanger; and said multipurpose valve having a second EGR outlet port fluidly connected to said EGR gas inlet of said heat exchanger.

3. The internal combustion engine of claim 2, wherein said heat exchanger having an air inlet and an air outlet, said intake manifold having an air outlet port fluidly connected with said an air inlet of said heat exchanger, and said multipurpose valve having a combustion air inlet port fluidly connected to said air outlet of said heat exchanger.

4. The internal combustion engine of claim 3, including:

a primary exhaust manifold in communication with at least a portion of said plurality of combustion cylinders, said primary exhaust manifold having a primary exhaust outlet port and a fluid inlet port; and said multipurpose valve having a fluid outlet port fluidly connected to said fluid inlet port of said primary exhaust manifold.

5. The internal combustion engine of claim 4, said multifunction valve being structured and arranged to be operable among a plurality of positions corresponding to a plurality of internal configurations.

6. The internal combustion engine of claim 4, said multifunction valve being structured and arranged to be operable in a first position corresponding to a first internal configuration such that said first valve inlet port is fluidly connected to said fluid outlet port.

7. The internal combustion engine of claim 4, said multifunction valve being structured and arranged to be operable in a second position corresponding to a second internal configuration such that said first valve inlet port is fluidly connected to said fluid outlet port and to said waste gas outlet port.

8. The internal combustion engine of claim 4, said multifunction valve being structured and arranged to be operable in a third position corresponding to a third internal configuration such that said first valve inlet port is fluidly connected to said first EGR outlet port.

9. The internal combustion engine of claim 4, said multifunction valve being structured and arranged to be operable in a fourth position corresponding to a fourth internal configuration such that said first valve inlet port is fluidly connected to said second EGR outlet port, and said combustion air inlet port is fluidly connected to said fluid outlet port.

10. The internal combustion engine of claim 4, said multifunction valve being structured and arranged to be operable in a fifth position corresponding to a fifth internal configuration such that said first valve inlet port is fluidly connected to said second EGR outlet port, and said combustion air inlet port is fluidly connected to said fluid outlet port and to said waste gas port.

11. The internal combustion engine of claim 4, including a turbocharger having a turbine and a compressor, said turbine having an exhaust gas inlet fluidly connected to said primary exhaust outlet port, and having an exhaust gas outlet, and said compressor having a compressor inlet and a compressor outlet, said compressor outlet being fluidly connected to said air intake port of said intake manifold.

12. The internal combustion engine of claim 1, including:

a heat exchanger having an air inlet and an air outlet;

said intake manifold having an air outlet port fluidly connected with said air inlet of said heat exchanger; and said multipurpose valve having a combustion air inlet port fluidly connected to said air outlet of said heat exchanger.

13. The internal combustion engine of claim 12, including:

a primary exhaust manifold in communication with at least a portion of said plurality of combustion cylinders, said primary exhaust manifold having a primary exhaust outlet and a fluid inlet port; and said multipurpose valve having a fluid outlet port fluidly connected to said fluid inlet port of said primary exhaust manifold.

14. The internal combustion engine of claim 1, said multifunction valve including a selector shaft, said internal combustion engine including:

an EGR controller; and an actuator electrically connected to said EGR controller, and mechanically connected to said selector shaft to operate said multifunction valve to a plurality of positions.

15. The internal combustion engine of claim 14, including a sensor assembly electrically coupled to said EGR controller, and adapted to monitor a status of at least one of a $CO_2$ content of said exhaust gas, an $NO_x$ content of said exhaust gas, an EGR rate, an engine speed, and an altitude.

16. The internal combustion engine of claim 1, said multifunction valve including a valve body having a plurality of cavities, a valve cap defining an exhaust gas pocket, and a rotor having a first surface, a second surface, a selection port and an air pocket defined by said first surface, said first surface being positioned to face said valve body and said second surface being positioned to face said exhaust gas pocket of said valve cap.

17. A multifunction valve for adjusting EGR in an internal combustion engine, comprising:

a valve body having a plurality of engine exhaust gas cavities, a waste exhaust cavity, and a hot combustion air cavity;

a valve cap defining an engine exhaust gas pocket; and a rotor having a first surface, a second surface, a selection port extending through said rotor from said first surface to said second surface and an air pocket defined by said first surface, said first surface being positioned to face said valve body, with said air pocket opening toward said valve body, and said second surface being positioned to face said exhaust gas pocket of said valve cap, said selection port and said air pocket adapted and arranged for establishing flow communication between and among said cavities and said exhaust gas pocket for providing selected EGR gas flow through the valve.

18. The multifunction valve of claim 17, said rotor being structured and arranged to be operable among a plurality of positions.

19. The multifunction valve of claim 17, including a first valve inlet port, a second valve inlet port, a first valve outlet port, a second valve outlet port, a third valve outlet port and a fourth valve outlet port.

20. The multifunction valve of claim 19, said rotor being structured and arranged to be operable in a first position, a second position, a third position, a fourth position and a fifth position, said first position corresponding to a first internal configuration such that said first valve inlet port is fluidly connected to said first valve outlet port, said second position corresponding to a second internal configuration such that said first valve inlet port is fluidly connected to said first valve outlet port and to said second valve outlet port, said third position corresponding to a third internal configuration such that said first inlet port is fluidly connected to said third valve outlet port, said fourth position corresponding to a fourth internal configuration such that said first valve inlet port is fluidly connected to said fourth valve outlet port and said second valve inlet port is fluidly connected to said first valve outlet port, and said fifth position corresponding to a fifth internal configuration such that said first valve inlet port is fluidly connected to said fourth valve outlet port, and said second valve inlet port is fluidly connected to said first valve outlet port and to said second valve outlet port.

21. A method of operating a multifunction valve in an EGR system for an internal combustion engine which generates exhaust gases, comprising the steps of:

operating said multifunction valve.in a first position to supply exhaust gas from a second exhaust manifold to a first exhaust manifold; and operating said multifunction valve in a second position to supply a portion of said exhaust gas from said second exhaust manifold to said first exhaust manifold and to at least partially open a waste port to waste a portion of said exhaust gases.

22. The method of claim 21, including the step of operating said multifunction valve in a third position to supply non-cooled exhaust gas to an intake manifold of said internal combustion engine.

23. The method of claim 21, including the step of operating said multifunction valve in a fourth position to supply cooled exhaust gas to an intake manifold of said internal combustion engine and to supply air received from said intake manifold to said first exhaust manifold.

24. The method of claim 21, including the step of operating said multifunction valve in a fifth position to supply cooled exhaust gas to an intake manifold of said internal combustion engine, to supply air received from said intake manifold to said first exhaust manifold and to at least partially open a waste port to waste a portion of said exhaust gases.

25. The method of claim 21 including the step of operating said multifunction valve using a single computer controlled actuator.

* * * * *